US006218627B1

(12) United States Patent
Shindo et al.

(10) Patent No.: US 6,218,627 B1
(45) Date of Patent: Apr. 17, 2001

(54) BUSHING

(75) Inventors: Katsuji Shindo; Toshiaki Rokunohe; Fumihiro Endo; Tokio Yamagiwa, all of Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/241,632

(22) Filed: Feb. 2, 1999

(30) Foreign Application Priority Data

Apr. 4, 1998 (JP) ..... 10-022953

(51) Int. Cl.[7] ..... H01B 17/58
(52) U.S. Cl. ..... 174/167; 174/142
(58) Field of Search ..... 174/167, 168, 174/169, 142, 143, 148, 152 R, 31 R

(56) References Cited

U.S. PATENT DOCUMENTS

| | | | | |
|---|---|---|---|---|
| 3,686,600 | * | 8/1972 | Conner et al. | 174/143 |
| 3,792,214 | * | 2/1974 | Voshall | 200/144 B |
| 4,424,402 | * | 1/1984 | Murase | 174/16 BH |
| 4,431,859 | * | 2/1984 | Kishida | 174/167 |
| 4,774,385 | * | 9/1988 | Toshima | 174/142 |
| 5,466,891 | | 11/1995 | Freeman et al. | 174/142 |
| 5,548,081 | * | 8/1996 | Rost | 174/148 BH |

FOREIGN PATENT DOCUMENTS

| | | | |
|---|---|---|---|
| 54-113094 | * | 9/1979 | (JP) . |
| 58-163111 | | 9/1983 | (JP) . |
| 60-86709 | | 5/1985 | (JP) . |
| 61-36006 | | 10/1986 | (JP) . |

* cited by examiner

*Primary Examiner*—Dean A. Reichard
*Assistant Examiner*—Adolfo Nino
(74) *Attorney, Agent, or Firm*—Mattingly, Stanger & Malur

(57) ABSTRACT

A bushing has a central conductor, and a plurality of internal shield rings. Gaps are formed between the shield rings such that equipotential lines extend through gaps. Electric field concentration in a tangential distribution on a part of the surface of the bushing corresponding to an upper part of an internal shield ring is relieved to prevent corona discharge under wet conditions, and antipollution performance and withstand voltage characteristics can be improved.

13 Claims, 11 Drawing Sheets

BUSHING

BACKGROUND OF THE INVENTION

1. Field of the Invention

The present invention relates to a bushing and, more specifically, to a bushing provided with internal shields suitable for reducing electric field concentration on the surface of the bushing.

2. Description of the Related Art

A conventional bushing is provided with a cylindrical shield coaxial with a central conductor and mounted inside an insulating tube, and an external shield ring mounted outside the insulating tube to control an external electric field.

A bushing disclosed in Japanese Patent Laid-open No. 58-163111 has a central conductor, a capacitor tube or a shield electrode for potential adjustment mounted so as to surround the central conductor, an insulating tube, a short insulating tube connected to the inner surface of the insulating tube, and an electrode for electric field relief mounted near the joint of the short insulating tube and the insulating tube. A bushing disclosed in Japanese Patent Laid-open No. 60-86709 has a central conductor, a first annular shield kept at a ground potential and mounted coaxially with the central conductor, and a plurality of annular shields supported in a stack by an impedance support member with the annular shield at an end of the stack mounted inside the first annular shield and kept at a potential other than the ground.

In the related art bushing, the coaxial cylindrical shield has a great height along the axis to control an electric field. Therefore, as is obvious from an equipotential distribution diagram shown in FIG. 11, all the potentials are raised axially along a cylindrical shield 110, potential is concentrated on a space near an upper part of the coaxial cylindrical shield 110, and the potentials are distributed in an outer space. Consequently, the electric field is concentrated on a part of the surface of the insulating tube 101 near the upper end of the coaxial cylindrical shield 110, which causes corona discharge under wet condition and deteriorates the antipollution ability. In particular, when a composite insulating tube formed by coating the surface of an insulating tube with an organic material, such as silicone rubber is employed, corona discharge in a wet state deteriorates the surface of the insulating tube, reduces reliability in insulation and the lifetime of the bushing may be shortened.

The bushing disclosed in Japanese Patent Laid-open No. 58-163111 has stacked internal shields and therefore has a problem in reliability in its insulating performance because the stacked internal shields may possibly be shifted or moved by earthquakes or mechanical vibrations of gas-insulated switchgear and the like. An internal shield internally with an electric field relieving shield, a connector on and a triple junction, cannot be achieved.

The plurality of shields of the bushing disclosed in Japanese Patent Laid-open No. 60-86709 cannot perfectly be gas-insulated because some parts of the shields are connected to the conductor by an impedance member. The provision of potential by impedance is likely to change with time. Since the impedance member is placed at the end of the shield where the intensity of the electric field is high, the dielectric strength is lower than that of the insulating member and reliability in insulating performance is not satisfactory.

SUMMARY OF THE INVENTION

A primary goal of the present invention is to provide a bushing capable of relieving electric field intensity concentration without increasing its inside diameter.

Another goal of the present invention is to provide a bushing capable of preventing the occurrence of corona discharge in a wet state and has excellent antipollution performance and dielectric characteristic.

With the foregoing goals in view, the present invention provides a bushing comprising an insulating tube, a central conductor mounted inside the insulating tube, a plurality of internal shields arranged at intervals along the axis of the central conductor, and conductive support members supporting the internal shields.

According to another aspect of the present invention, a bushing comprises an insulating tube, a central conductor mounted inside the insulating tube, and a plurality of internal shields arranged at intervals along the axis of the central conductor, in which the internals shields are held at a ground potential.

According to still another aspect of the present invention, a bushing comprises an insulating tube, a central conductor mounted inside the insulating tube, and a plurality of internal shields arranged at intervals along the axis of the central conductor, in which the internal shields are arranged so that the intervals between the internal shields increase gradually toward a high-voltage terminal of the central conductor.

In any one of the foregoing bushings of the present invention, the inside diameters of the internal shields decrease gradually toward the high-voltage terminal of the central conductor or the inside diameters of the internal shields close to the high-voltage terminal of the central conductor are at least smaller.

In any one of the foregoing bushings of the present invention, the internal shield on the side of the ground potential has a shape having a part thereof extending along the central conductor and having a length greater than the lateral distance between the insulating tube and the internal shield.

DETAILED DESCRIPTION OF THE PREFERRED EMBODIMENTS

Figure 1:
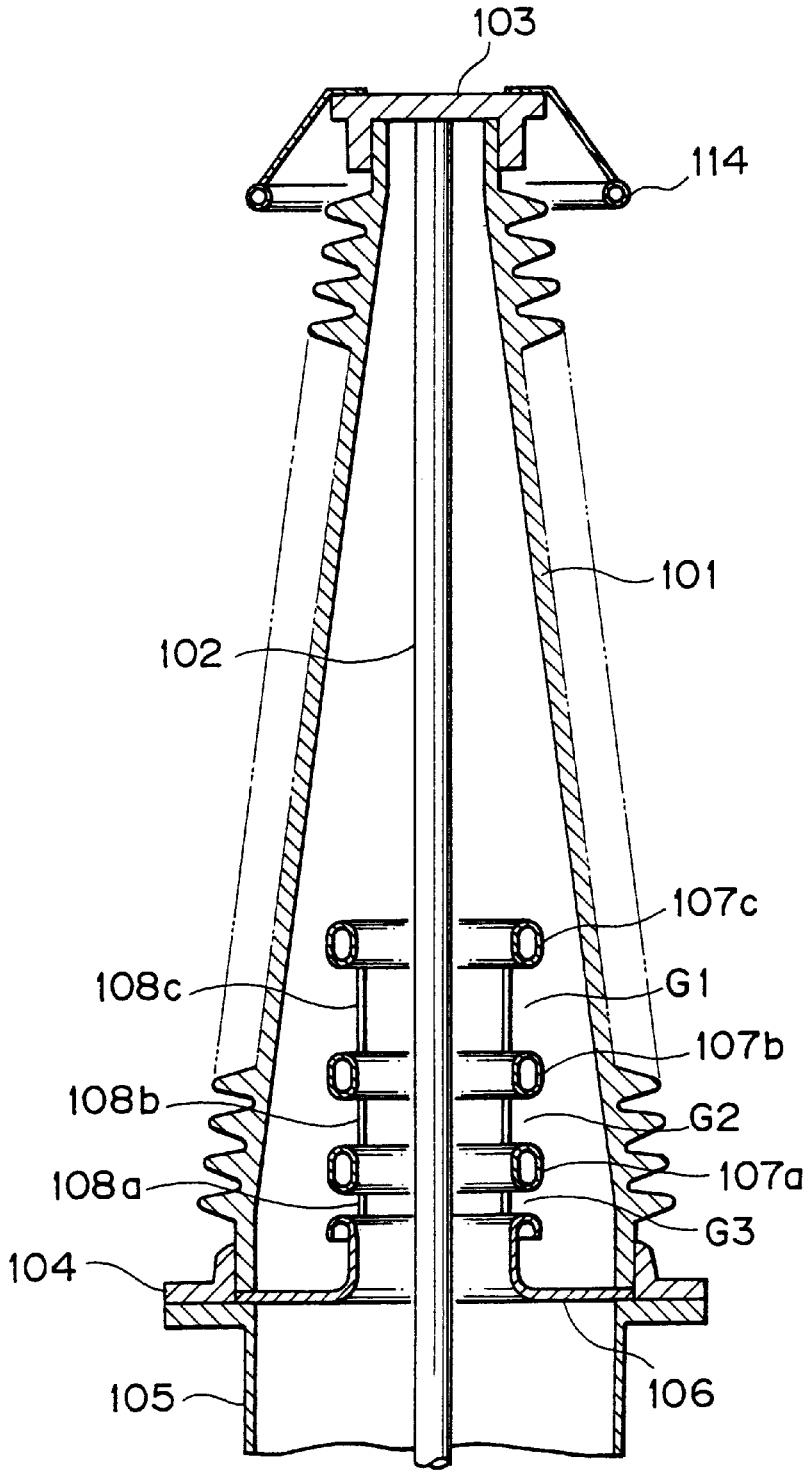
FIG. 1 is a longitudinal sectional view of a bushing in a first embodiment according to the present invention.

A bushing in a first embodiment according to the present invention will be described with reference to the accompanying drawings. FIG. 1 is a longitudinal sectional view of the bushing, and FIG. 2 is an enlarged longitudinal sectional view of a lower portion of the bushing of FIG. 1, showing potential distribution on the bushing.

The bushing in this embodiment employs a composite insulating tube made of a ceramic material or a FRP material (fiberglass reinforced plastic material). The bushing has an insulating tube 101 and a central conductor 102 mounted in the insulating tube 101. A high-voltage terminal 103 is attached to the upper end of the insulating tube 101 and is connected electrically to the central conductor 102. An external shield 114 is supported near the upper end of the insulating tube 101. A flange 104 is attached to the lower end of the insulating tube 101 and is joined to a metal sheath 105. An insulating gas or an insulating liquid is sealed in the bushing. The insulating gas could be, for example, $SF_6$ gas, carbon dioxide gas or nitrogen gas. The insulating liquid could be, for example, insulating oil or perphluorocarbon.

Ring shields 107*a*, 107*b* and 107*c*, each having a toroidal shape are mounted inside the insulating tube 101 so as to surround the central conductor 102, and are connected to a ground potential. The ring shields 107*a*, 107*b* and 107*c* are spaced by a plurality of support conductors 108*a*, 108*b* and 108*c* so as to form gaps G1, G2 and G3. The support conductor 108*a* is attached to a conductive cylindrical support member 106 fixedly held between the the bottom of the insulating tube 101 and the top of the metal sheath 105. The lengths of the shield gaps G1, G2 and G3 spacing the ring shields 107*a*, 107*b* and 107*c* are adjusted so that potential is able to pass through the shield gaps G1, G2 and G3 and is distributed outside. It is effective to form the top shield gap G1 to have a larger length. Potential on the surface of the insulating tube of the bushing can be reduced when G1>G2>G3.

Figure 2:
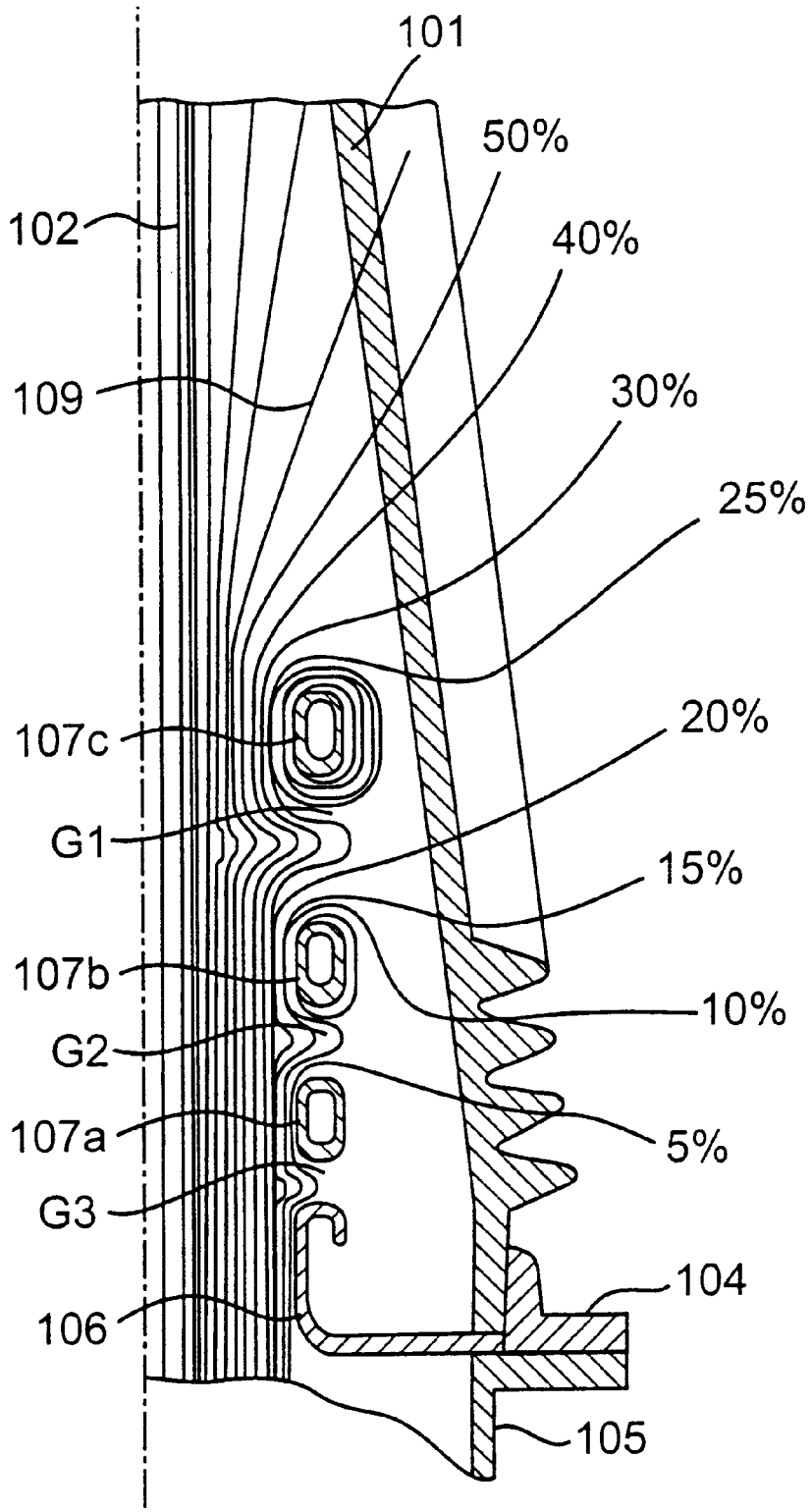
FIG. 2 is an enlarged longitudinal sectional view of the bushing, showing potential distribution on a lower right hand portion of the bushing of FIG. 1.

As shown in FIG. 2, equipotential lines 109 are distributed around the ring shields 107*a*, 107*b* and 107*c* in the bushing thus constructed, and some equipotential lines 109 extend outside through the shield gaps G1, G2 and G3 and are distributed in an external space. This distribution is dependent on gap length. The equipotential lines 109 of below 25% extend through the shield gaps G1, G2 and G3 and are distributed outside, and the equipotential lines 109 under the top ring shield 107*c* are evenly distributed as shown in FIG. 2, by way of example. The equipotential lines 109 extend at increased intervals around a region on the surface of the insulating tube 101 corresponding to the top ring shield 107*c*. Therefore, the electric field intensity in a tangential distribution on the surface of the insulating tube 101 can be reduced by several percent. Consequently, corona discharge can be prevented, withstand voltage is increased, and a lower external shield ring employed in the prior art bushings to prevent the breakage of the insulating tube by an intense electric field around the extremity of the internal shield can be omitted. Although the central conductor 102 generates heat when a current flows therethrough, air circulates satisfactorily by convection within the insulating tube 101 to enhance its cooling effect because the shield gaps G1, G2 and G3 are formed between the shield rings.

Figure 3:
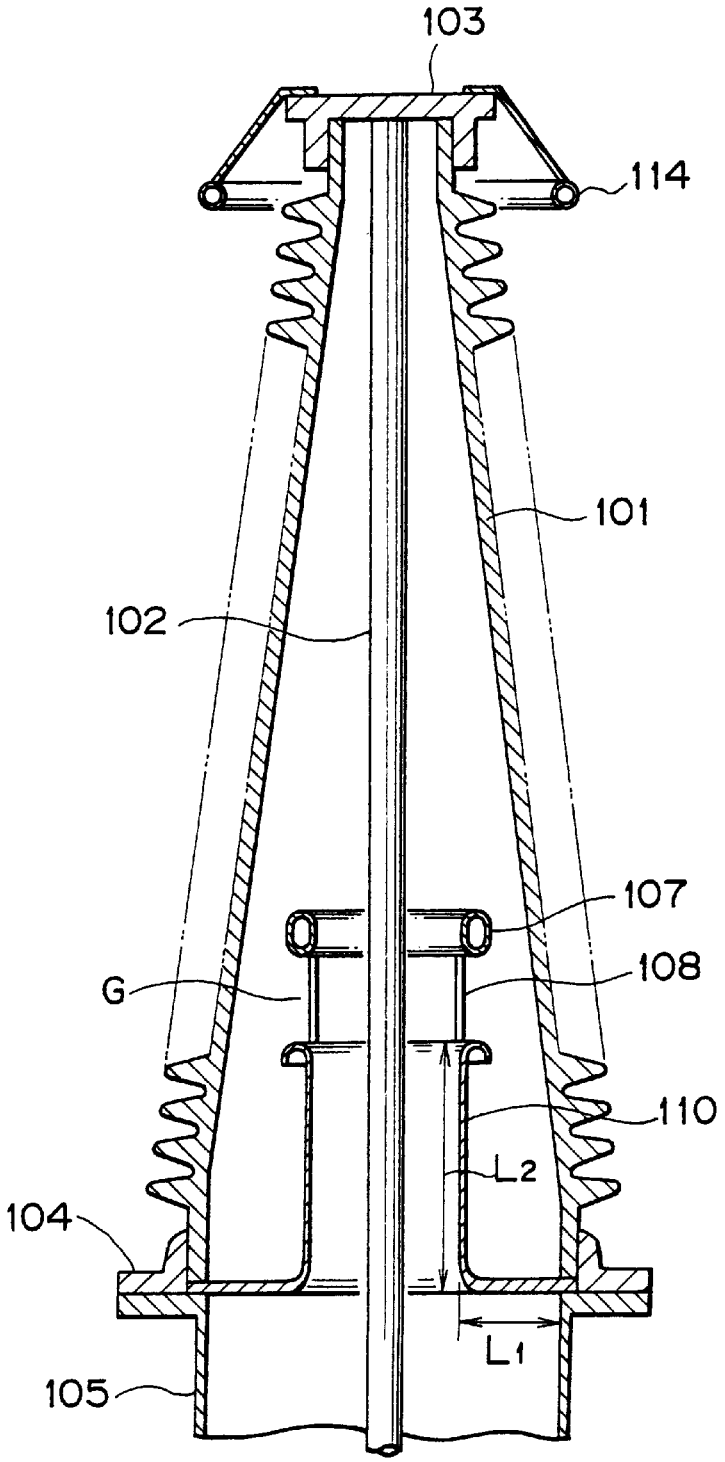
FIG. 3 is a longitudinal sectional view of a bushing in a second embodiment according to the present invention.

A bushing in a second embodiment according to the present invention will be described with reference to FIGS. 3 and 4. FIG. 3 is a longitudinal sectional view of the bushing in the second embodiment according to the present invention, and FIG. 4 is an enlarged, sectional view of the lower right hand portion of the bushing shown in FIG. 3.

In this embodiment, the internal shields are coaxial cylindrical shield 110, and a ring shield 107 coaxial with the cylindrical shield 110. The ring shield 107 is supported by a supporting conductor 108 on the coaxial cylindrical shield 110 so as to form a gap G between the ring shield 107 and the cylindrical shield 110. The supporting conductor 108 has the shape of a pipe. The construction of this bushing is simple and reduces the number of ring shields. Only the adjustment of the shield gap G between the shields is necessary for satisfactory performance. When the shield gap G between the shields is adjusted properly, the effect of the ring shield is substantially the same as that of a plurality of ring shields. When the inside diameter of the ring shield 107 is smaller than that of the cylindrical shield 110, intervals between equipotential lines on the surface of an insulating tube 101 are wide, and the electric field intensity in a tangential distribution on the surface of the insulating tube 101 can further be reduced. The supporting conductor 108 may have the shape of a cylinder or a plate instead of a pipe. The cylindrical shield may be perforated.

Figure 4:
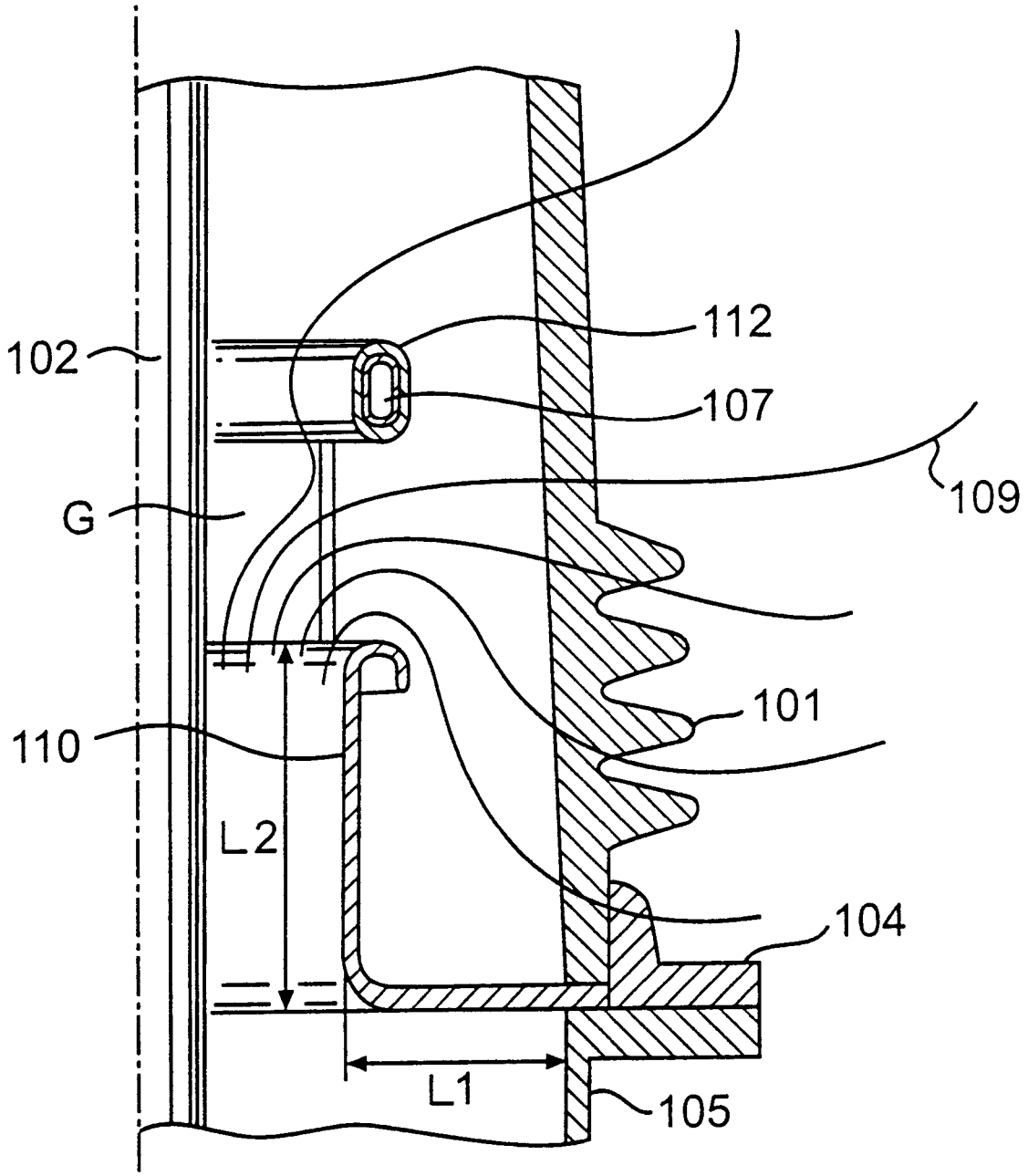
FIG. 4 is a zoom-in longitudinal sectional view of a lower right hand portion of the internal shield shown in FIG. 3.

As shown in FIG. 4, equipotential lines 109 are distributed around the ring shield 107 and the cylindrical shield 110 in the bushing shown in FIG. 3. Since the gap G is formed between the ring shield 107 and the cylindrical shield 110, some of the equipotential lines 109 extend through the gap G and are distributed to the space outside of the insulating tube 101. The distribution of the equipotential lines 109 in the space outside of the insulating tube is dependent on the gap length. Since the equipotential lines 109 extend through the gap G and are distributed in the space outside of the insulating tube similarly to the distribution of the equipotential lines shown in FIG. 2, the equipotential lines 109 under the ring shield 107 are evenly distributed. The cylindrical shield 110 is formed so that the length $L_2$ of the cylindrical shield 110 along the central conductor 102 is greater than the lateral distance $L_1$ between the insulating tube 101 and the cylindrical shield 110 to equalize the equipotential lines 109 distributed through the gap G in the outer space. Consequently, the distribution of the equipotential lines 109 on an outer surface near flange 104 can be evenly distributed. The intensity of the electric field in a tangential distribution on the surface of the insulating tube 101 can be reduced by optimizing the length $L_2$ of the cylindrical shield 110 so that the equipotential lines 109 are distributed thinly on a part of the surface of the insulating tube 101 near the top ring shield 107 and by disposing the top ring shield 107 above the cylindrical shield 110.

As shown in FIG. 4, the top ring shield 107 is coated with an insulating coating 112. Since all the equipotential lines 109 are raised by the internal shields, the field intensity on the surface of the top ring shield 107 becomes high. The insulating coating 112 on the top ring shield 107 relieves the surface electric field intensity, and therefore increases withstand voltage.

Figure 5:
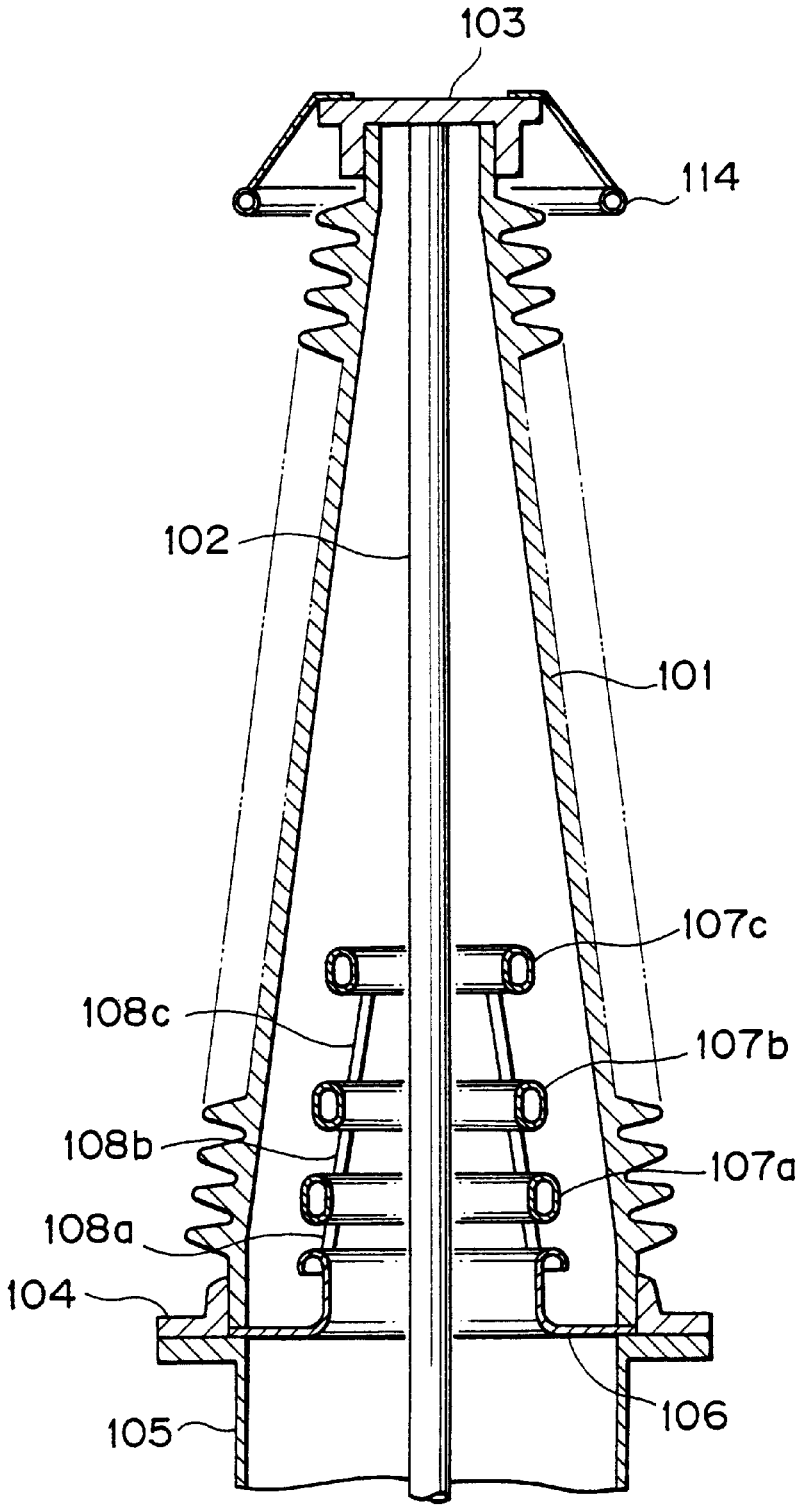
FIG. 5 is a longitudinal sectional view of a bushing in a third embodiment according to the present invention.

A bushing in a third embodiment according to the present invention will be described with reference to FIG. 5. FIG. 5 is a longitudinal sectional view of the bushing in the third embodiment.

The bushing in the third embodiment, similarly to the bushing in the first embodiment shown in FIGS. 1 and 2, is provided with a plurality of ring shields 107*a*, 107*b* and 107*c*, i.e., internal shields. The inside diameters of upper ones of the ring shields 107*a*, 107*b* and 107*c* are smaller than those of lower ones. When such ring shields 107*a*, 107*b* and

107*c* are employed, the area of a surface on which electric field intensity is higher than a fixed value facing a central conductor 102 is reduced and therefore reliability in insulating performance can be improved. When the top ring shield 107*c* is coated with an insulating coating, electric field intensity on the surface of the top ring shield 107*c* can be relieved. Therefore, the distance between the top ring shield 107*c* and the central conductor 102 can be reduced which will increase the distance between the top ring shield 107*c* and insulating tube. In this way, the electric field intensity in a tangential distribution on the surface of the insulating tube 101 can further be reduced and evenly distributed.

Figure 6:
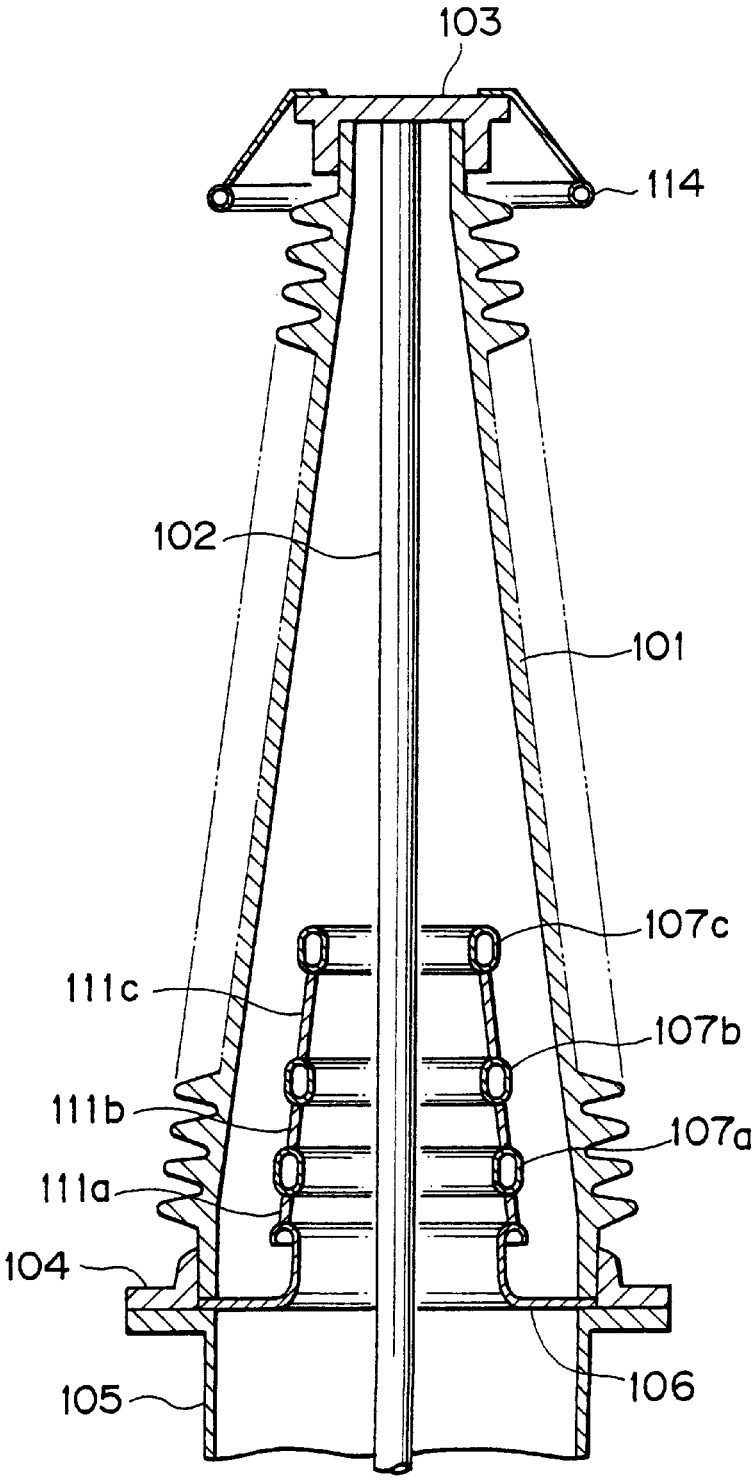
FIG. 6 is a longitudinal sectional view of a bushing in a fourth embodiment according to the present invention.

A bushing in a fourth embodiment according to the present invention will be described with reference to FIG. 6. FIG. 6 is a longitudinal sectional view of the bushing in the fourth embodiment.

In the fourth embodiment, a plurality of ring shields 107*a*, 107*b* and 107*c* are connected by insulating supports 111*a*, 111*b* and 111*c*. Potentials of upper ones of the ring shields 107*a*, 107*b* and 107*c* are higher than those of lower ones of the ring shields due to capacitive potential distribution, and the voltage difference between a high-voltage central conductor 102 and the upper ring shield is smaller than lower ones. Accordingly, the inside diameters of the upper ones of the ring shields 107*a*, 107*b* and 107*c* may be smaller than those of the lower ones, and the internal shields may be of small diameters. Accordingly, electric field intensity on the surface of the insulating tube 101 of the bushing in the fourth embodiment is lower than that on the surface of the insulating tube 101 of the bushing shown in FIG. 5, the bushing can be made in a smaller diameter, corona discharge can be prevented or mitigated and withstand voltage will increased.

Figure 7:
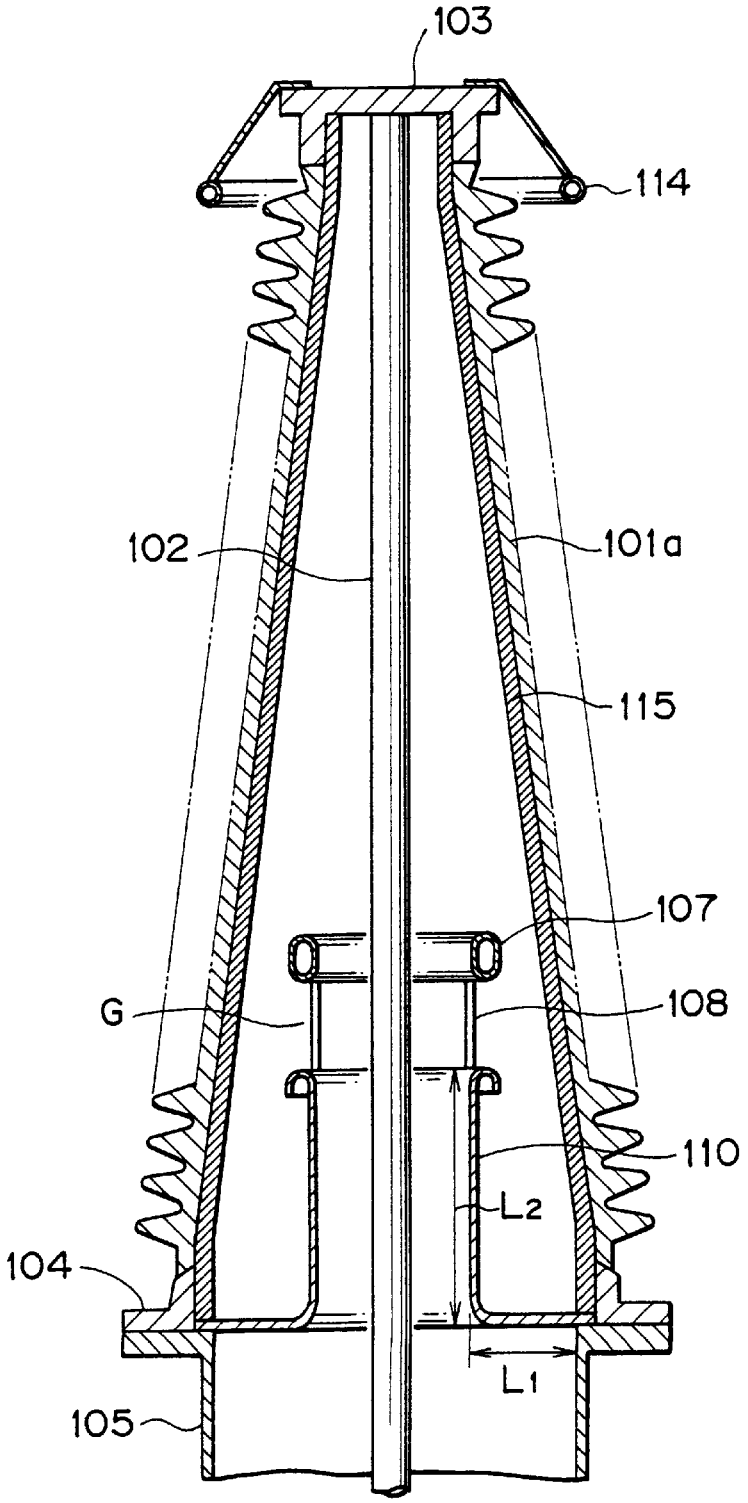
FIG. 7 is a longitudinal sectional view of a bushing in a fifth embodiment according to the present invention employing a composite insulating tube.

A bushing in a fifth embodiment according to the present invention will be described with reference to FIG. 7. FIG. 7 is a longitudinal sectional view of the bushing in the fifth embodiment.

The fifth embodiment employs a composite insulating tube. The composite insulating tube is formed by fitting an inner insulating tube 115 of a FRP material in an outer nonceramic insulating tube 101*a* of weather-resistant rubber. The material covering the FRP insulating tube 115 is, for example, silicone rubber, EVA (ethylene-vinyl acetate), EPDM or EPR (ethylene propylene copolymer). It is possible that the lifetime of the bushing may be shortened by the degradation of the composite insulating tube due to tracking or cracking caused by partial discharge or local arcing on the surface of the bushing. Since internal shields shown in FIG. 7 mounted in the composite insulating tube reduce electric field intensity in a tangential distribution on the surface of the insulating tube 101*a*, corona discharge and local arcing can be prevented, the reliability of the bushing in insulating performance can be enhanced and the shortening of the lifetime of the bushing can be avoided.

Similarly to the bushing provided with the coaxial cylindrical shield and the ring shield as shown in FIG. 3, the bushing in this embodiment is provided with a cylindrical shield 110 having a length $L_2$ along a central conductor greater than the lateral distance $L_1$ between the insulating tube 115 and the coaxial cylindrical shield 110 to equalize the distribution of equipotential lines. The bushing in the fifth embodiment, similarly to those shown in FIGS. 1, 5 and 6, may be provided with a plurality of ring shields for better performance.

Figure 8:
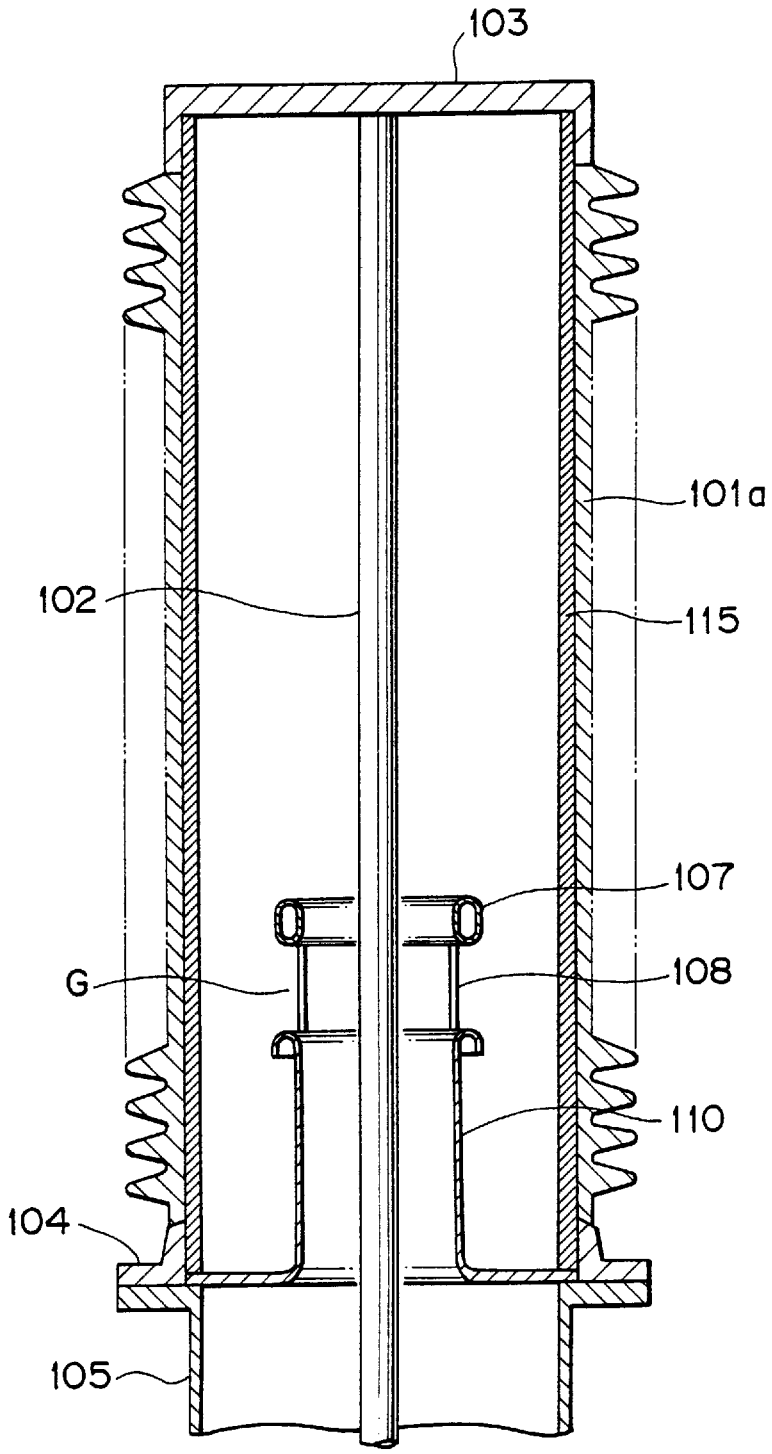
FIG. 8 is a longitudinal sectional view of a bushing in a sixth embodiment according to the present invention employing a composite insulating tube.

A bushing in a sixth embodiment according to the present invention is described with reference to FIG. 8. FIG. 8 is a longitudinal sectional view of the bushing in the sixth embodiment employing a composite insulating tube similar to that employed in the bushing shown in FIG. 7. In FIGS. 7 and 8, parts of the same materials are designated by the same reference characters.

As shown in FIG. 8, the composite insulating tube has a cylindrical shape and is comprised of an inner insulating tube 115 and an outer tube 101*a*. Since the distribution of equipotential lines on the insulating tube is evenly distributed by a coaxial cylindrical shield 110 and the ring shield 107, corona discharge and local arcing can be prevented, the reliability of the bushing can be enhanced and the shortening of the lifetime of the bushing can be avoided.

Figure 9:
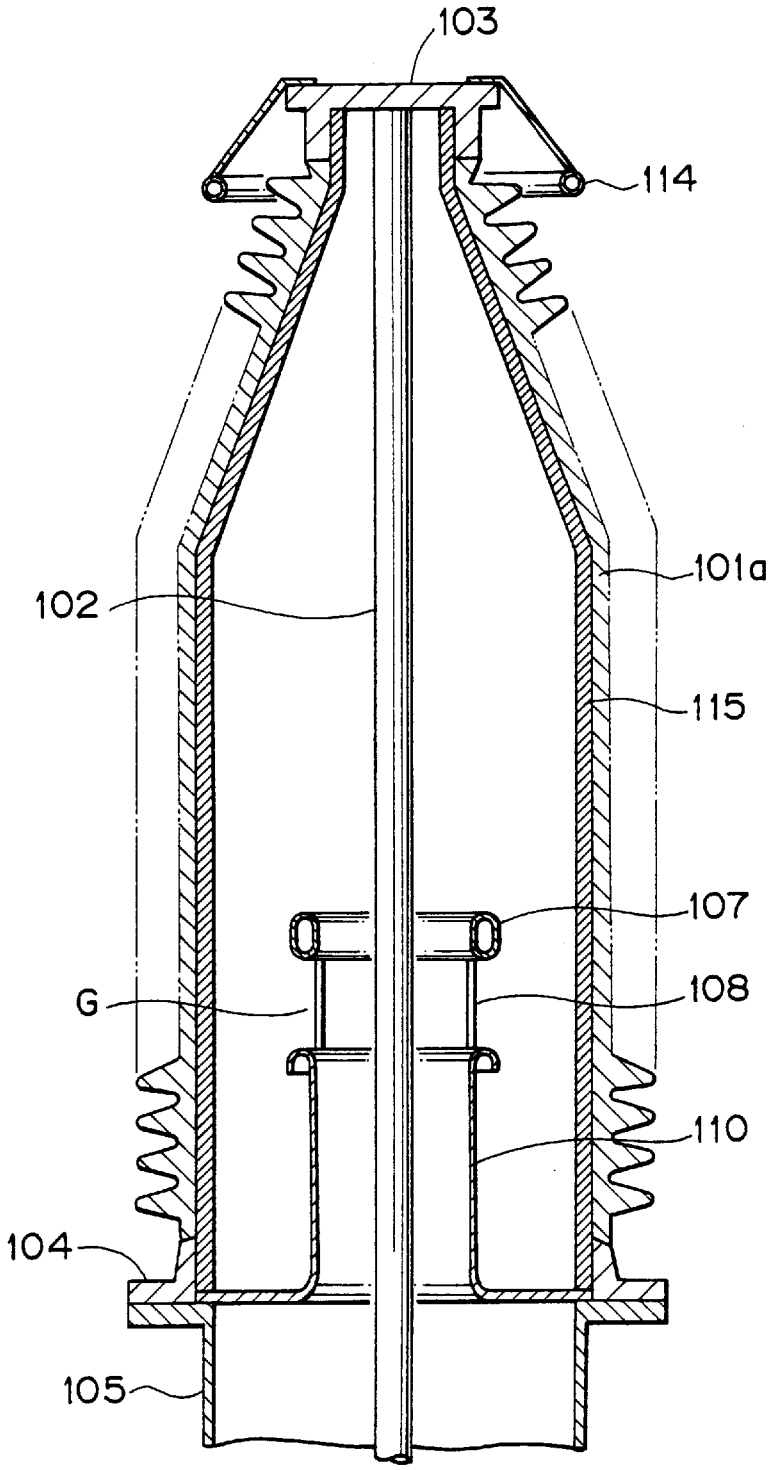
FIG. 9 is a longitudinal sectional view of a bushing in a seventh embodiment according to the present invention employing a composite insulating tube.

A bushing in a seventh embodiment according to the present invention will be described with reference to FIG. 9. FIG. 9 is a longitudinal sectional view of the bushing in the seventh embodiment employing a composite insulating tube similar to that employed in the bushing shown in FIGS. 7 and 8. In FIGS. 7 8 and 9, parts of the same materials are designated by the same reference characters.

The overall shape of the bushing shown in FIG. 9 is different from that of the bushing shown in FIGS. 7 and 8. As shown in FIG. 9, the bushing has a generally conical upper part towards the high-voltage terminal. Since the bushing has the conical part on the side of the high-voltage terminal, the capacity of the composite insulating tube may be small and the distribution of equipotential lines around the part of the insulating tube on the side of the high-voltage terminal is more evenly distributed. The distribution of equipotential lines on the insulating tube can further be evenly distributed by forming the bushing of parts having different shapes, such as a first cylindrical part, a first conical part connected to the first cylindrical part, a second cylindrical part connected to the first conical part and a second conical part connected to the second cylindrical part.

Figure 10:
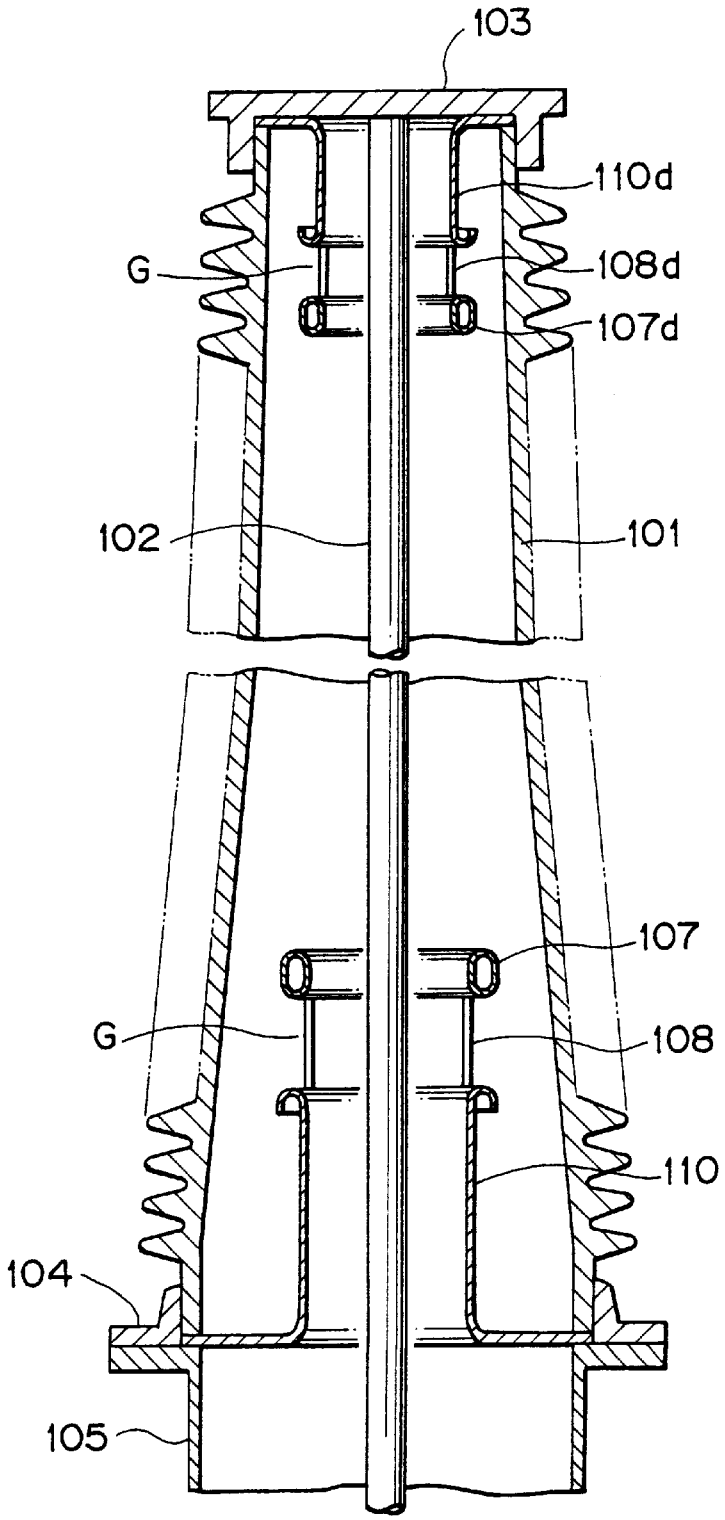
FIG. 10 is a longitudinal sectional view of a bushing in an eighth embodiment according to the present invention provided with an upper and a lower inner shield.
Figure 11:
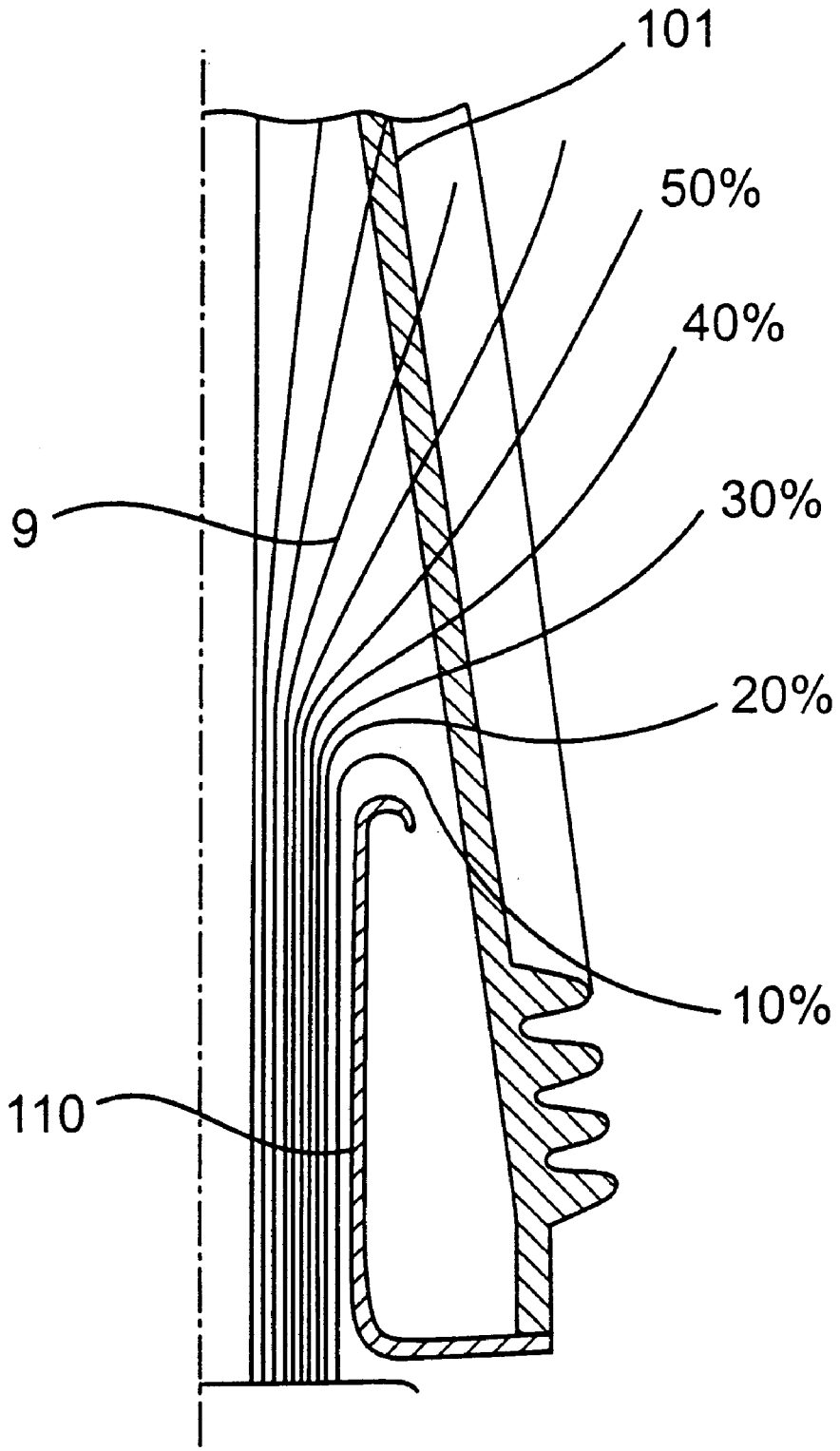
FIG. 11 is an enlarged longitudinal sectional view of a lower right hand portion of a prior art bushing showing potential distribution on the bushing.

A bushing in an eighth embodiment according to the present invention is described with reference to FIG. 10. FIG. 10 is a longitudinal sectional view of the bushing in the eighth embodiment.

As shown in FIG. 10, the bushing is provided with internal shields similar to those mentioned above in an upper part and a lower part thereof. When a cylindrical shield 110*d* and a ring shield 107*d* similar to those mounted in the lower part of the bushing are mounted in the upper part of the bushing, electric field intensity in a tangential distribution on the surface of an upper part of the insulating tube can be reduced. The potential of the upper internal shields is equal to that of the high-voltage terminal 103. Therefore, any external shield ring corresponding to the external shield ring 114 mounted around the upper part of the insulating tube of the bushing shown in FIG. 3 is not necessary, and the cost therefore can be reduced. In a composite insulating tube having an inner insulating tube of a FRP material, heat radiated from a conductor can be intercepted by the internal shields and hence the temperature rise of the composite insulating tube can be suppressed.

As is apparent form the foregoing description, according to the present invention, a bushing is provided internally with a plurality of shield rings arranged at intervals to relieve electric field intensity in a tangential distribution on the surface of the insulating tube. Therefore, corona discharge under wet conditions can be prevented, antipollution performance is improved, and the effect of cooling the interior of the insulating tube can be improved. Moreover, an external shield may not be necessary, the insulating tube may be formed with a small diameter and the cost can be reduced.

What is claimed is:

1. A bushing comprising: an insulating tube; a central conductor mounted inside the insulating tube; a plurality of internal shields arranged along the axis of the central conductor so as to form gaps between the adjacent internal shields, the plurality of internal shields having inside diameters, and a conductive support supporting the plurality of internal shields whereby the plurality of internal shields are electrically connected to each other to be kept at the same potential.

2. The bushing according to claim 1, wherein the inside diameters of the internal shields decrease gradually toward a high-voltage terminal of the central conductor.

3. The bushing according to claim 1, wherein the internal shields are connected by insulating media.

4. The bushing according to claim 1, wherein at least the internal shield closest to a high-voltage terminal of the central conductor is coated with an insulating coating.

5. The bushing according to claim 1, wherein at least some of the plurality of internal shields are ring shields respectively having toroidal shapes.

6. The bushing according to claim 1, wherein the lowest internal shield on the side of the ground potential among the plurality of internal shields has a length along the central conductor greater than the lateral distance between the inner surface of the insulating tube and said lowest internal shield.

7. The bushing according to claim 1, wherein the insulating tube is a composite insulating tube.

8. The bushing according to claim 7, wherein said composite insulating tube is comprised of an inner insulating tube and an outer insulating tube.

9. The bushing according to claim 8, wherein said inner insulating tube is constructed of a fiberglass reinforced plastic material and said outer insulating tube is constructed of a nonceramic material.

10. The bushing according to claim 9, wherein said nonceramic material of said outer insulating tube is a weather-resistant rubber.

11. A bushing comprising: an insulating tube; a central conductor mounted inside the insulating tube; and a plurality of internal shields arranged along the axis of the central conductor so as to form gaps between the adjacent internal shields; and wherein the plurality of internal shields are kept at the same ground potential.

12. A bushing comprising: an insulating tube; a central conductor mounted inside the insulating tube; and a plurality of internal shields arranged along the axis of the central conductor so as to form gaps between the adjacent internal shields; and wherein the internal shields are arranged so that the lengths of the gaps between the adjacent internal shields increase in a direction toward a high-voltage terminal of the central conductor.

13. The bushing according to claim 12, wherein a high voltage terminal of the central conductor is adjacent at least one shield kept at a potential equal to the voltage of the high-voltage terminal of the central conductor.

* * * * *